US006274988B1

(12) United States Patent
De Vries

(10) Patent No.: US 6,274,988 B1
(45) Date of Patent: Aug. 14, 2001

(54) OPEN LOOP CURRENT CONTROL BALLAST LOW PRESSURE MERCURY GERMICIDAL UV LAMPS

(75) Inventor: Pieter De Vries, London (CA)

(73) Assignee: R-Can Environmental Inc., Guelph (CA)

( * ) Notice: Subject to any disclaimer, the term of this patent is extended or adjusted under 35 U.S.C. 154(b) by 0 days.

(21) Appl. No.: 09/492,290

(22) Filed: Jan. 27, 2000

(51) Int. Cl.[7] ..... H05B 37/02
(52) U.S. Cl. ..... 315/307; 315/224; 315/291
(58) Field of Search ..... 315/219, 224, 315/225, 244, 247, 209 R, 291, 307, 360

(56) References Cited

U.S. PATENT DOCUMENTS

| | | | | |
|---|---|---|---|---|
| 2,928,994 | * | 3/1960 | Widakowitch | 315/205 |
| 4,060,751 | * | 11/1977 | Anderson | 315/209 R |
| 4,060,752 | * | 11/1977 | Walker | 315/244 |
| 4,498,031 | * | 2/1985 | Stupp et al. | 315/307 |
| 4,585,974 | * | 4/1986 | Stupp et al. | 315/307 |
| 4,698,544 | * | 10/1987 | Stupp et al. | 315/307 |
| 4,700,113 | * | 10/1987 | Stupp et al. | 315/224 |
| 4,717,863 | * | 1/1988 | Zieler | 315/307 |
| 4,727,470 | * | 2/1988 | Nilssen | 363/132 |
| 5,289,083 | * | 2/1994 | Quazi | 315/224 |
| 5,437,060 | * | 7/1995 | Delamater et al. | 455/63 |
| 5,563,477 | * | 10/1996 | Ribarich et al. | 315/291 |

OTHER PUBLICATIONS

Stan Gibilisco, Encyclopedia of Electronics for Technicians and Hobbyists, McGraw–Hill, p. 592, 1997.*
Charles A. Schuler, Electronics Principles and Applications, McGraw–Hill, pp. 350 and 351, 1998.*

* cited by examiner

*Primary Examiner*—Haissa Philogene
*Assistant Examiner*—Wilson Lee
(74) *Attorney, Agent, or Firm*—R. Craig Armstrong

(57) ABSTRACT

An apparatus for starting and operating UV lamps, comprises an AC line powered circuit and a UV lamp. The circuit has a variable frequency AC source, providing AC current to the UV lamp and a ballasting inductor, connected in series with the UV lamp. The inductor and the lamp form a nonresonant coupling sub-circuit where a flow of current from the AC source through the UV lamp is limited by the ballasting inductor. The circuit does not develop dangerously high output voltages if the UV lamp is disconnected or burnt out, as would be the case with resonant output circuits, unless additional circuit protection was implemented. The impedance of the ballast inductor varies with the current frequency, enabling it to act as a current control element with changes in the output frequency. An open loop control circuit of the present invention maintains the lamp current at a relatively constant level without the complexity imposed by closed loop current control methods.

12 Claims, 2 Drawing Sheets

OPEN LOOP CURRENT CONTROL BALLAST LOW PRESSURE MERCURY GERMICIDAL UV LAMPS

BACKGROUND OF THE INVENTION

1. Field of the Invention

This invention relates to an improved low cost open loop current stabilization circuit for starting and operating ultra violet (UV) lamps, and more particularly for starting and operating low pressure germicidal UV lamps used in water sterilization apparatus.

2. Description of the Prior Art

The performance of water sterilization apparatus utilizing low pressure germicidal UV lamps is directly related to absolute current flow in the UV lamp.

The ballast circuits used in UV water sterilizer applications today are generally modified versions of ballasts originally developed for fluorescent lighting applications. These ballasts generally have no current control function, and this results in the current flow in the low pressure mercury UV lamp varying with changes in the input supply voltage. In the case of simple magnetic ballasts, current flow in the low pressure mercury UV lamp will also vary with frequency of the input AC power.

The reliability of many of the ballasts presently used in UV water sterilization apparatus, especially when operating from 240 volt AC input power and utilizing short arc length lamps, has not been satisfactory.

Various types of ballast circuits utilizing the frequency modulation current control technique are well known in the art.

U.S. Pat. No. 2,928,994 by Widakowitch shows a saturable core variable frequency DC powered inverter whose frequency varies as a function of the DC supply voltage to maintain the current flowing in the lamp relatively constant.

U.S. Pat. No. 4,060,751 by Anderson and U.S. Pat. No. 4,060,752 by Walker both describe inverter circuits in which the switching elements are commutated when the instantaneous current exceeds a predetermined level. The lamp is coupled to the inverter output with a series inductor capacitor network with the lamp connected across the capacitor element. Before ignition the lamp appears as a high impedance shunted across the capacitor. On power up the inverter output sees only the series inductor capacitor network and is forced to operate at the resonant frequency of the series inductor capacitor combination. As the resonance voltage builds, the point at which lamp ignition is initiated is reached and the negative impedance of the ignited lamp effectively shunts the series capacitor. After the lamp is ignited, the inverter switches are commutated when the instantaneous lamp current exceeds the predetermined current threshold. As the rate of current rise increases, the predetermined current reference point will be reached more quickly increasing the frequency of oscillation of the inverter and reducing the current flow through the series combination of the ballast inductor and UV lamp. As the rate of current rise decreases the amount of time to reach the predetermined current switching threshold is extended, lowering the frequency of oscillation and allowing more current to flow through the series combination of the ballast inductor and UV lamp.

U.S. Pat. No. 4,498,031 by Stupp, U.S. Pat. No. 4,585,974 by Stupp, U.S. Pate. No. 4,698,554 by Stupp and U.S. Pat. No. 4,700,113 by Stupp disclose a ballast circuit consisting of driven push-pull inverter circuit driven by a voltage controlled oscillator whose output is divided by two with flip-flop circuit to insure symmetrical drive to the inverter switches. In all cases a closed loop current sensing circuit controls the frequency of the voltage controlled oscillator. The use of smaller filter capacitors to filter the pulsating DC output of the AC to DC rectifier to improve the circuit power factor is claimed and implication of improved lamp current crest factor though not specifically mentioned is obvious from the operational description. The use of analog, digital and hybrid analog digital implementations for the oscillators is discussed.

U.S. Pat. No. 4,717,863 by Zieler describes a ballast circuit with a driven push-pull inverter and non resonant output network. The output frequency of the inverter is at the lower limit of operation on start up to provide maximum preheat current to the lamp filaments.

Control of the lamp current after ignition using closed loop circuits based on lamp current or measuring lamp output with a photo-detector circuit are described. Additionally, an interface to allow the desired output level to be programmed by an external computer input is disclosed.

U.S. Pat. No. 4,727,470 by Nilssen describes a ballast circuit utilizing a self oscillating half-bridge inverter topology using a saturable core transformer in the feed back Idop. The lamp is connected to the inverter output across the capacitor of series inductor capacitor network. On start up the lamp appears as a high impedance parallel with the capacitor element of the series inductor capacitor output network and the inverter oscillates at the resonant frequency of this network. As the resonance voltage builds, the lamp is ignited and the capacitor is effectively shunted out of the series inductor capacitor network by the negative impedance of the lamp. The operating frequency of the inverter when the lamp is ignited is determined by the saturation flux density of the saturable core transformer feedback element. A technique for modifying the saturation point of the saturable core feedback element in both closed loop and open loop current control topologies is described. Improved powerfactor and lamp current crest factor are both claimed.

SUMMARY OF THE INVENTION

It is an object of the present invention to provide an improved ballast circuit for starting and operating low-pressure mercury germicidal UV discharge lamps, particularly in UV water sterilization apparatus.

In the invention, an improved apparatus for starting and operating UV lamps, comprises an AC line powered circuit, for example a frequency modulated inverter, and one or more UV lamps. The circuit has a variable frequency AC source, for instance comprising an inverter driven by a voltage controlled oscillator (VCO), providing current to the UV lamps and a ballasting inductor, connected in series with the UV lamps. The inductor and the lamps form a nonresonant coupling sub-circuit where a flow of current from the AC source through the UV lamps is limited by the ballasting inductor. The output frequency of the VCO is modulated by changes in the input voltage.

The UV lamps are preferably low pressure mercury germicidal UV lamps, and preferably used in a UV water sterilizing apparatus.

The AC source preferably comprises a rectifier filter and an inverter, the inverter being driven by a frequency modulated VCO circuit.

The frequency modulated inverter is preferably a driven half-bridge inverter.

The VCO circuit preferably comprises a varactor-tuned voltage controlled RC oscillator. A drive signal, that commutates the frequency modulated inverter, is obtained from the varactor-tuned voltage controlled RC oscillator, so that the output frequency of the oscillator is modulated by the variations in the input supply voltage for maintaining a substantially constant current flow through the series connected ballasting inductor and the UV lamps.

The output of the varactor-tuned voltage controlled RC oscillator is preferably divided by a flip-flop circuit, to insure symmetry of the drive signal.

The varactor-tuned voltage controlled RC oscillator preferably comprises a 555 timer equivalent integrated circuit.

Advantageously, at least a portion of a frequency determining resistance of the varactor-tuned voltage controlled RC oscillator comprises a variable resistance, to enable the effects of component tolerances to be eliminated during the manufacturing process and during use of the apparatus.

Thus, a preferred circuit of the present invention utilizes a frequency modulated half bridge inverter whose output is coupled to a UV lamp with a series current limiting inductor. The output coupling circuit is non-resonant and does not develop dangerously high output voltages if the UV lamp is disconnected or burnt out, as would be the case with resonant output circuits unless additional circuit protection is implemented.

The half-bridge output stage is driven by a varactor diode tuned voltage controlled oscillator through a divided by two flip-flop circuit to insure drive symmetry. The oscillator circuit of the present invention incorporates an adjustable resistor in the frequency-determining portion to enable all component tolerances to be compensated for when calibrated during manufacture. Additionally the frequency of the voltage controlled oscillator is modulated by the value of the input supply voltage in a predetermined manner so as to provide the optimum operating conditions for the lamp over a wide variation in input supply voltage.

The impedance of the ballast inductor varies with the current frequency, enabling it to act as a current control element with changes in the inverter output frequency. The open loop control circuit of the present invention maintains the lamp current at a relatively constant level without the complexity imposed by closed loop current control methods.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
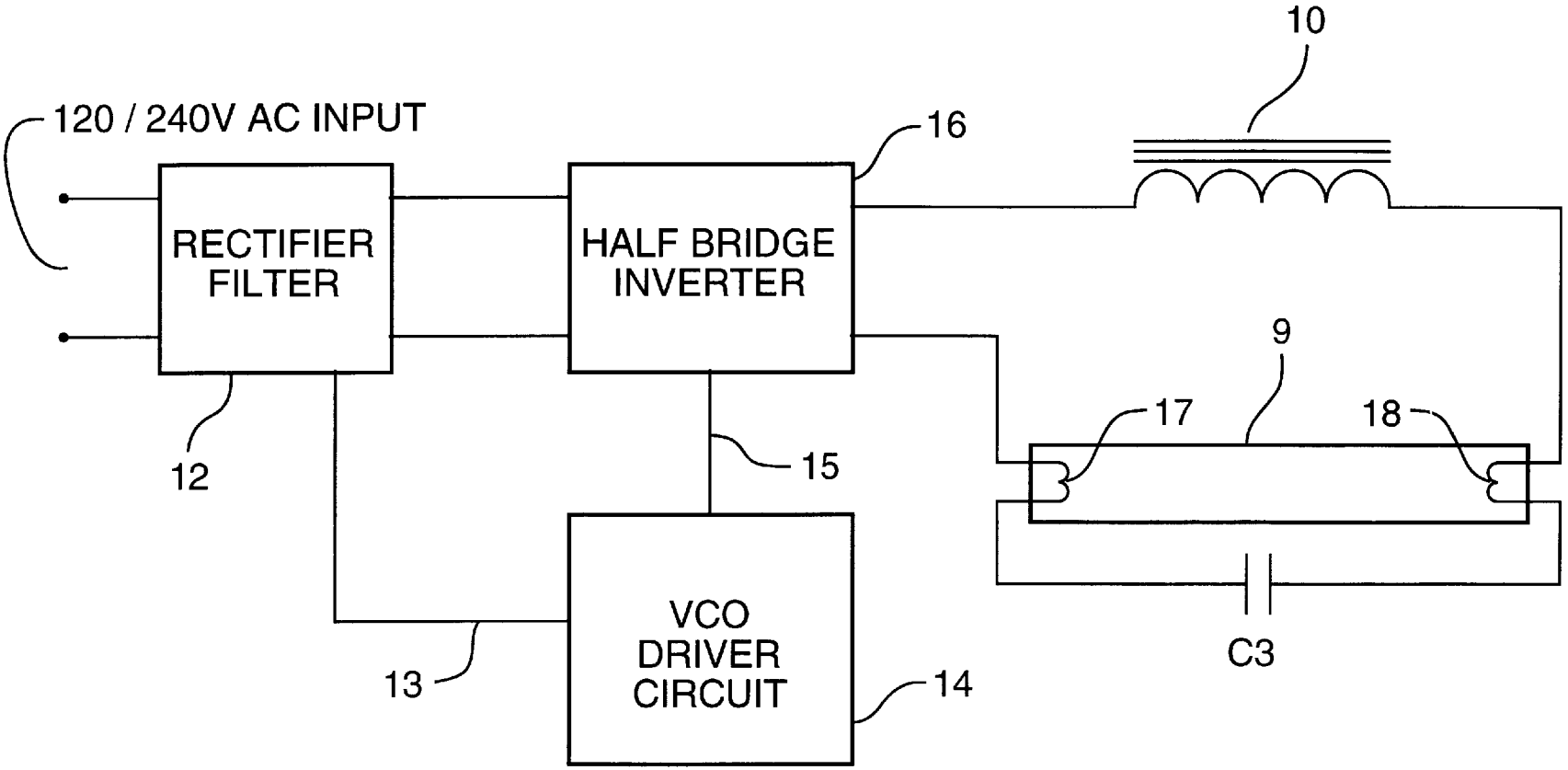
FIG. 1 is a functional block diagram of the preferred embodiment of the invention.

FIG. 1 is a functional diagram of a preferred embodiment of the present invention. The AC input supply voltage is converted to filtered DC by a conventional diode rectifier 12 with filter capacitor(s). A sample of the AC supply voltage 13 is also routed to a voltage controlled oscillator 14, which provides a drive signal 15 for an inverter circuit 16, for example a half-bridge inverter. The filaments 17 and 18 of a low-pressure mercury germicidal UV lamp 9 are connected to the output of the half-bridge inverter 16 in series with a ballasting inductor 10. The impedance of the ballasting inductor varies with the frequency, and can therefore be used to control the current flowing in the circuit if the output frequency of the half-bridge inverter 16 can be varied. The tuning characteristics of an oscillator 14, for example a varactor tuned voltage controlled oscillator, are designed so that the output frequency of the half-bridge inverter 16 will result in a substantially constant current flow in the ballast inductor 10 over the full allowable range of input supply voltages. When power is first applied to the ballast circuit the impedance of the low pressure mercury germicidal UV lamp 9 is very high and the inverter output is forced to flow through the filaments 17 and 18 and pre-heat capacitor C3 (see FIG. 2). The value of the pre-heat capacitor C3 is selected so that it will not form a resonant condition with ballasting inductor 10 under any condition. Once the filaments 17,18 have reached the critical temperature to enable the lamp to ignite, the impedance of the pre-heat capacitor C3 is effectively bypassed from the circuit by the negative impedance of the ignited low pressure mercury germicidal UV lamp 9.

Figure 2:
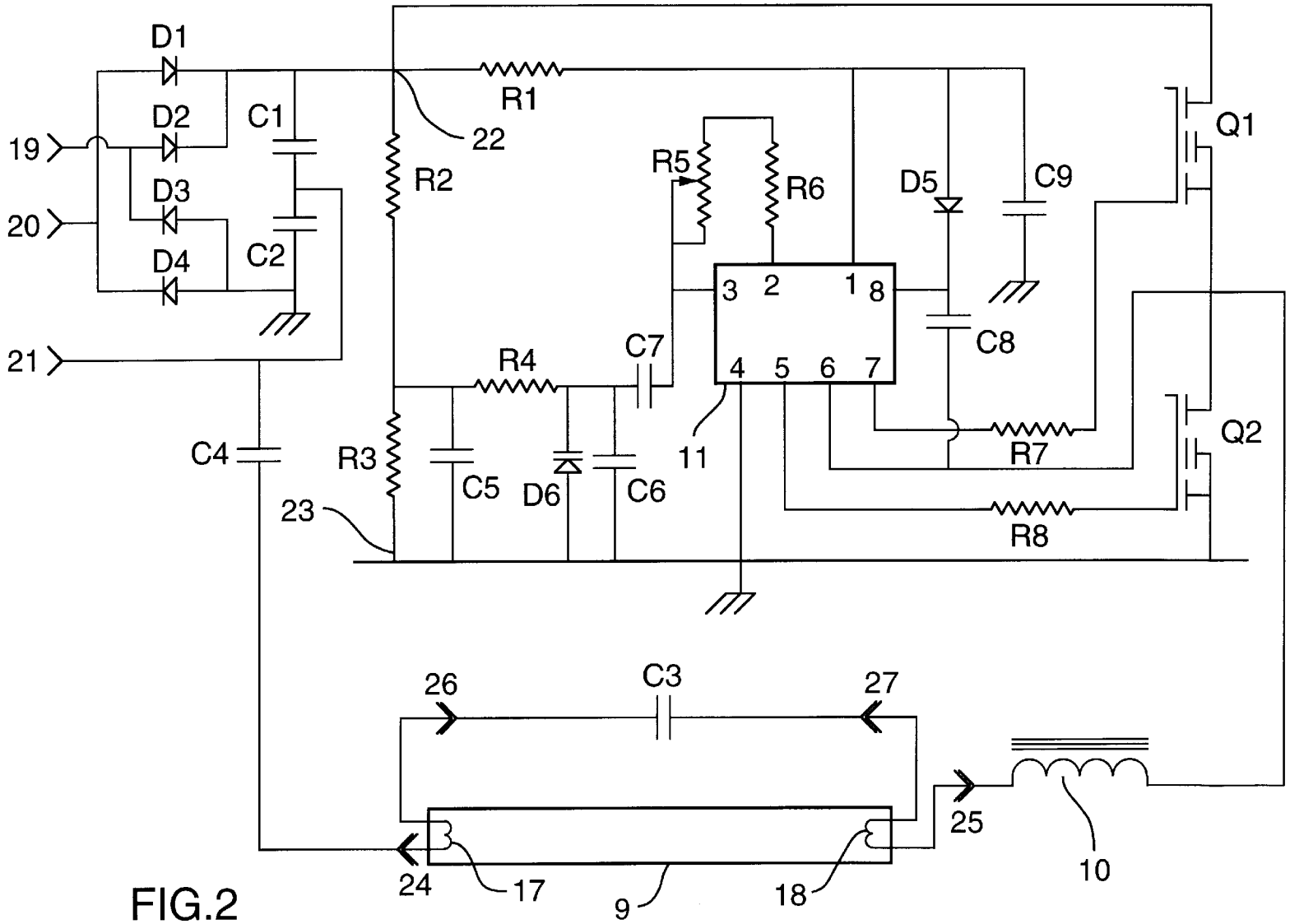
FIG. 2 is a schematic diagram of the preferred embodiment of the invention.

A preferred embodiment of a ballast and starting circuit of the present invention is shown schematically in FIG. 2. Direct current to operate the inverter is obtained from the AC line input voltage from a rectifier, filter capacitor arrangement consisting of diodes D1, D2, D3, D4 and filter capacitors C1 and C2.

The rectifier arrangement of the preferred embodiment of FIG. 2 can be operated as a full wave bridge rectifier consisting of diodes D1, D2, D3, and D4 when a 240 volt input supply voltage is connected to terminals 19 and 20 with the filter capacitors Cl and C2 acting as both a filter capacitor and a capacitive voltage divider. For operation from a 120 volt AC input supply the input supply is connected to terminals 19 and 21. In this configuration the circuit consisting of diodes D2, D3 and filter capacitors C1 and C2 operates as a conventional voltage doubler. This rectifier, filter capacitor arrangement enables the use of the same circuit and components for both voltage ranges.

The commutation of the half-bridge output circuit of the preferred embodiment described in FIG. 2 is provided by integrated circuit 11, which combines both the voltage regulator, oscillator and frequency divider functions as well as drivers for the FET switching elements Q1 and Q2. The integrated circuit 11 power supply regulator consisting of a zener diode connected to pin 1, is powered from the rectifier filter circuit via voltage dropping resistor R1 and filter capacitor C9. The DC supply voltage of the internal voltage regulator is bootstrapped to the high side driver portion of the integrated circuit 11 by diode D5 and capacitor C8. The oscillator function of the integrated circuit 11 is an RC oscillator similar to that found in the familiar 555 timer integrated circuit. The oscillator timing components consists of resistor R6 in series with variable resistor R5, the parallel arrangement of capacitor C6 and the capacitance of varactor diode D6 determine the oscillator frequency of oscillation. The value of variable resistance R5 is selected such that it is capable of calibrating out any errors in output frequency due to component tolerance during manufacturing. The bias on the varactor tuning diode is provided by voltage divider of resistor R2 and R3. One side of resistor R2 is connected to the positive DC voltage from the rectifier, filter circuit 22 with remaining side of resistor R2 connected to one side of resistor R3. The remaining side of resistor R3 is connected to the DC supplies negative voltage of the rectifier, filter circuit 23. The values of resistors R2 and R3 are selected so as to bias the varactor diode at the center of its range under nominal input AC supply voltage conditions. Capacitor C7 isolates the RC oscillator functions of the integrated circuit 11 from the DC bias voltage applied to the varactor diode D6. The capacitance value of capacitor C7 is much greater than the total value of the sum of capacitors C6 and varactor diode D6 so as to have a negligible effect on the frequency of oscillation of the RC oscillator. The value of the RC oscillator timing components, resistor R6, R5 and capacitor C6 in a parallel arrangement with the varactor diode D6, are selected so that the change in oscillator frequency with variations in input voltage results in a substantially constant current flowing through the series arrangement of the low pressure mercury UV lamp 9 ballasting inductor 10 and coupling capacitor C4. Coupling capacitor C4 eliminates any DC component from the voltage applied to the low pressure mercury germicidal UV lamp. The commutation drive to the switching elements of the half-bridge inverter FET Q1 and Q2 is supplied by an high side driver circuit on the integrated circuit 11 via resistors R7 and R8.

The low pressure mercury germicidal UV lamp 9 in the preferred embodiment of FIG. 2 is a preheat type of lamp and is connected to the ballast circuit via terminals 24,25,26 and 27. Starting of the low pressure mercury germicidal UV lamp 9 is assisted by a preheat current flowing through the lamp filaments 17 and 18 through capacitor C3, which is connected to terminals 26 and 27 of the ballast circuit. Once the low pressure mercury germicidal UV lamp is ignited, the capacitor C3 is effectively shunted from the lamp circuit by the negative impedance of the low pressure mercury germicidal UV lamp 9. The preferred embodiment of FIG. 2 is specifically designed for use with preheat lamps, but the present invention is not limited to only this type of lamp. For example, if used with short arc length lamps, no starting circuit at all would be required and use of instant start type lamps could be accommodated by increasing the level of the DC supply voltage to the half-bridge inverter.

While a preferred embodiment of the invention has been described in detail many modifications may be effected by those skilled in the art. Accordingly it is intended by the appended claims to cover all such claims as fall within the true spirit and scope of the invention.

It will be appreciated that the above description relates to the preferred embodiment by way of example only. Many variations on the invention will be obvious to those knowledgeable in the field, and such obvious variations are within the scope of the invention as described and claimed, whether or not expressly described.

What is claimed as the invention is:

1. An apparatus for starting and operating UV lamps, comprising an AC line powered circuit and at least one UV lamp, wherein said circuit comprises:

a variable frequency AC source, arranged to provide current to said at least one UV lamp;

a ballasting inductor connected in series with said at least one UV lamp, said inductor and said at least one UV lamp forming an open-loop current control and non-resonant coupling sub-circuit, and where a flow of current from said AC source through said at least one UV lamp is limited by said ballasting inductor in said sub-circuit, wherein said AC source comprises a rectifier filter and an inverter, said inverter driven by a frequency modulated VCO circuit, and said VCO circuit comprises a varactor-tuned voltage controlled RC oscillator receiving a rectified sample of the AC supply voltage directly routed to the VCO circuit from said AC source, and where a drive signal that commutates said frequency modulated inverter is obtained from said varactor-tuned voltage controlled RC oscillator, so that the output frequency of said oscillator is modulated bv the variations in the input supply voltage for maintaining a substantially constant current flow through said ballasting inductor and said at least one UV lamp.

2. The apparatus according to claim 1, where said at least one-UV lamp comprises low pressure mercury germicidal UV lamps.

3. The apparatus according to claim 1, where said frequency modulated inverter comprises a driven half-bridge inverter.

4. The apparatus according to claim 3, where said at least one UV lamp comprises low pressure mercury germicidal UV lamps.

5. The apparatus according to claim 1, where the output of said varactor-tuned voltage controlled RC oscillator is divided by a flip-flop circuit, to insure symmetry of the drive signal.

6. The apparatus according to claim 5, where said at least one UV lamp comprises low pressure mercury germicidal UV lamps.

7. The apparatus according to claim 1, where said varactor-tuned voltage controlled RC oscillator comprises a 555 timer equivalent integrated circuit.

8. The apparatus according to claim 7, where said at least one UV lamp comprises low pressure mercury germicidal UV lamps.

9. The apparatus according to claim 5, where said varactor-tuned voltage controlled RC oscillator comprises a 555 timer equivalent integrated circuit.

10. The apparatus according to claim 9, where said at least one UV lamp comprises low pressure mercury germicidal UV lamps.

11. The apparatus according to claim 1, wherein at least a portion of a frequency determining resistance of said varactor-tuned voltage controlled RC oscillator comprises a variable resistance, to enable the effects of component tolerances to be eliminated during the manufacturing process and during use of said apparatus.

12. The apparatus according to claim 11, where said at least one UV lamp comprises low pressure mercury germicidal UV lamps.

* * * * *